US012760971B2

(12) United States Patent
Lin

(10) Patent No.: US 12,760,971 B2
(45) Date of Patent: Oct. 13, 2026

(54) THREE-DIMENSIONAL VAPOR CHAMBER BONDING STRUCTURE

(71) Applicant: TAIWAN MICROLOOPS CORP., New Taipei City (TW)

(72) Inventor: Chun-Hung Lin, New Taipei City (TW)

(73) Assignee: TAIWAN MICROLOOPS CORP., New Taipei City (TW)

( * ) Notice: Subject to any disclaimer, the term of this patent is extended or adjusted under 35 U.S.C. 154(b) by 117 days.

(21) Appl. No.: 18/892,322

(22) Filed: Sep. 20, 2024

(65) Prior Publication Data

US 2026/0055969 A1 Feb. 26, 2026

(30) Foreign Application Priority Data

Aug. 20, 2024 (TW) ..... 113131323

(51) Int. Cl.
*F28D 15/02* (2006.01)
*F28D 15/04* (2006.01)

(52) U.S. Cl.
CPC ..... *F28D 15/0266* (2013.01); *F28D 15/04* (2013.01)

(58) Field of Classification Search
CPC .. F28D 15/0266; F28D 15/04; F28D 15/0275; F28D 15/0283
See application file for complete search history.

(56) References Cited

U.S. PATENT DOCUMENTS

| | | | | |
|---|---|---|---|---|
| 4,145,708 | A * | 3/1979 | Ferro | H10W 40/611 257/722 |
| 6,738,257 | B1 * | 5/2004 | Lai | F28F 1/32 174/15.2 |
| 7,926,553 | B2 * | 4/2011 | Dautert | F28D 15/0266 165/104.33 |
| 10,048,015 | B1 * | 8/2018 | Lin | F28D 15/0266 |
| 10,126,069 | B2 * | 11/2018 | Sun | F28D 15/046 |
| 10,451,355 | B2 * | 10/2019 | Lan | F28D 15/0275 |
| 12,366,419 | B2 * | 7/2025 | Wang | F28D 15/0233 |
| 12,535,278 | B2 * | 1/2026 | Lin | F28D 15/0233 |
| 2003/0173064 | A1 * | 9/2003 | Ueki | H10W 40/73 29/890.032 |

(Continued)

FOREIGN PATENT DOCUMENTS

| | | | |
|---|---|---|---|
| CN | 223274387 | U | 8/2025 |
| TW | M662928 | U | 11/2024 |
| TW | M663393 | U | 11/2024 |

*Primary Examiner* — Travis Ruby
(74) *Attorney, Agent, or Firm* — HDLS IPR SERVICES; Chun-Ming Shih

(57) ABSTRACT

A three-dimensional vapor chamber bonding structure includes a housing, heat pipes, a capillary member, and a working fluid. The housing includes a first shell plate and a second shell plate, creating a cavity between them. The second shell plate is equipped with through-holes, each through-hole surrounded by a recessed groove. The heat pipes, which each include an open end equipped with a flange, extend through the through-holes with the flanges received in the recessed grooves. The heat pipes are joined to the second shell plate through the flanges and weldments inside the recessed grooves. The capillary member is installed within the cavity and adhered to the housing. The working fluid is contained within the cavity.

6 Claims, 7 Drawing Sheets

(56) References Cited

U.S. PATENT DOCUMENTS

| | | | | |
|---|---|---|---|---|
| 2004/0105235 | A1* | 6/2004 | Lai | F28F 1/32 361/700 |
| 2005/0173098 | A1* | 8/2005 | Connors | F28D 15/02 165/104.21 |
| 2010/0263834 | A1* | 10/2010 | Hwang | H10W 40/226 165/104.26 |
| 2017/0312871 | A1* | 11/2017 | Lin | B23P 15/26 |
| 2017/0314873 | A1* | 11/2017 | Lin | B23P 15/26 |
| 2017/0356694 | A1* | 12/2017 | Tan | F28D 15/0275 |
| 2018/0274866 | A1* | 9/2018 | Zhao | F28D 15/0275 |
| 2018/0279463 | A1* | 9/2018 | Zhao | H05K 1/0203 |
| 2019/0049190 | A1* | 2/2019 | Liu | F28F 1/325 |
| 2019/0128617 | A1* | 5/2019 | Mira | F28D 15/0275 |
| 2019/0162480 | A1* | 5/2019 | Shen | F28D 15/046 |
| 2019/0343021 | A1* | 11/2019 | Zhang | H05K 7/20336 |
| 2020/0060044 | A1* | 2/2020 | Numoto | H05K 7/20336 |
| 2021/0180876 | A1* | 6/2021 | Kojima | F28D 15/0233 |
| 2023/0047466 | A1* | 2/2023 | Jiang | F28D 15/0266 |
| 2023/0213288 | A1* | 7/2023 | Wang | F28F 3/02 165/104.26 |
| 2023/0358482 | A1* | 11/2023 | Liu | F28D 15/04 |
| 2024/0151333 | A1* | 5/2024 | Liao | F28F 21/081 |

* cited by examiner

THREE-DIMENSIONAL VAPOR CHAMBER BONDING STRUCTURE

BACKGROUND OF THE DISCLOSURE

Technical Field

The present disclosure relates to a technical field of heat dissipation, and more particularly, to a three-dimensional vapor chamber bonding structure.

Description of Related Art

A three-dimensional vapor chamber structure in related art mainly includes a vapor chamber and a plurality of heat pipes. The heat pipes are vertically and arranged spaced apart on the vapor chamber, and a cavity inside the vapor chamber is in communication with chambers of the heat pipes, thereby achieving rapid heat conduction and heat dissipation performance through the phase change between vapor and liquid.

However, although the three-dimensional vapor chamber structure of related art has heat conduction and heat dissipation performance, there are still the following problems to be solved in actual use. Since each heat pipe and the vapor chamber are joined using solder such as copper paste or tin paste, they are prone to loosening and other undesirable situations due to vibration during assembly or transportation. In addition, during the manufacturing process, copper paste or tin paste can easily enter the cavity, thereby impairing or obstructing the transmission path of the internal working fluid, thus reducing its heat conduction and heat dissipation performance.

In view of this, the applicant of the present disclosure has conducted in-depth research and combined with the disclosure of theory to address the aforementioned shortcomings in the related art, which has become the goal of the applicant's improvement.

SUMMARY OF THE DISCLOSURE

An objective of the present disclosure is to provide a three-dimensional vapor chamber bonding structure that not only has a robust and high-strength bond but also prevents low-melting-point solder from entering the cavity and interfering with the transmission of the working fluid.

To achieve the above objective, the present disclosure provides a three-dimensional vapor chamber bonding structure, including a housing, a plurality of heat pipes, a capillary member, and a working fluid. The housing includes a first shell plate and a second shell plate that is hermetically sealed against the first shell plate, forming a cavity between the first shell plate and the second shell plate. The second shell plate includes a plurality of through-holes, each of the through-holes surrounded by a recessed groove. The heat pipes extend through the through-holes respectively, each heat pipe including an open end, and each of the open ends is provided with a flange. Each of the flanges is received in one of the recessed grooves, and each of the heat pipes is joined to the second shell plate through the flange and a weldment within the recessed groove. The capillary member is disposed within the cavity and adheres to the housing. The working fluid is contained in the cavity.

The present disclosure also has the following advantages. It prevents low-melting-point solder, such as copper paste or tin paste, from clogging the pores of the capillary member after melting due to heat during the processing. This ensures that the movement path of the internal working fluid remains unobstructed. The manufacturing process minimizes thermal effects and reduces deformation of the workpiece. Moreover, the resulting bonded structure is exceptionally strong and reliable.

DETAILED DESCRIPTION

The detailed description and technical content of the present disclosure are explained in conjunction with the accompanying drawings. However, the attached drawings are for illustrative purposes only and are not intended to limit the scope of the present disclosure.

Please refer to FIGS. 1 to 7. The present disclosure provides a three-dimensional vapor chamber bonding structure. The three-dimensional vapor chamber bonding structure mainly includes a housing 10, a plurality of heat pipes 20, a capillary member 30, and a working fluid 40.

Figure 5:
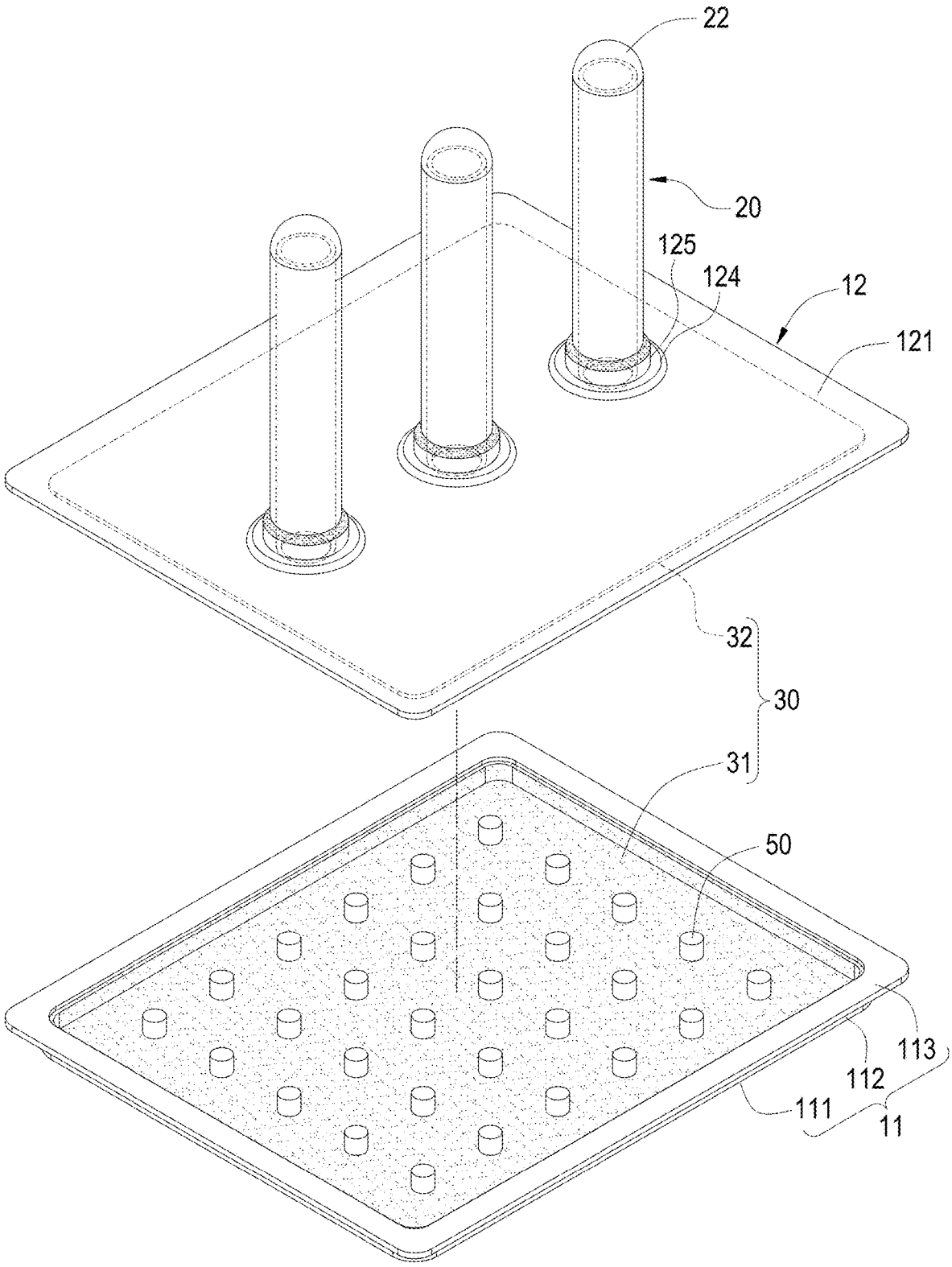
FIG. 5 is an exploded view of a three-dimensional vapor chamber bonding structure of the present disclosure.
Figure 6:
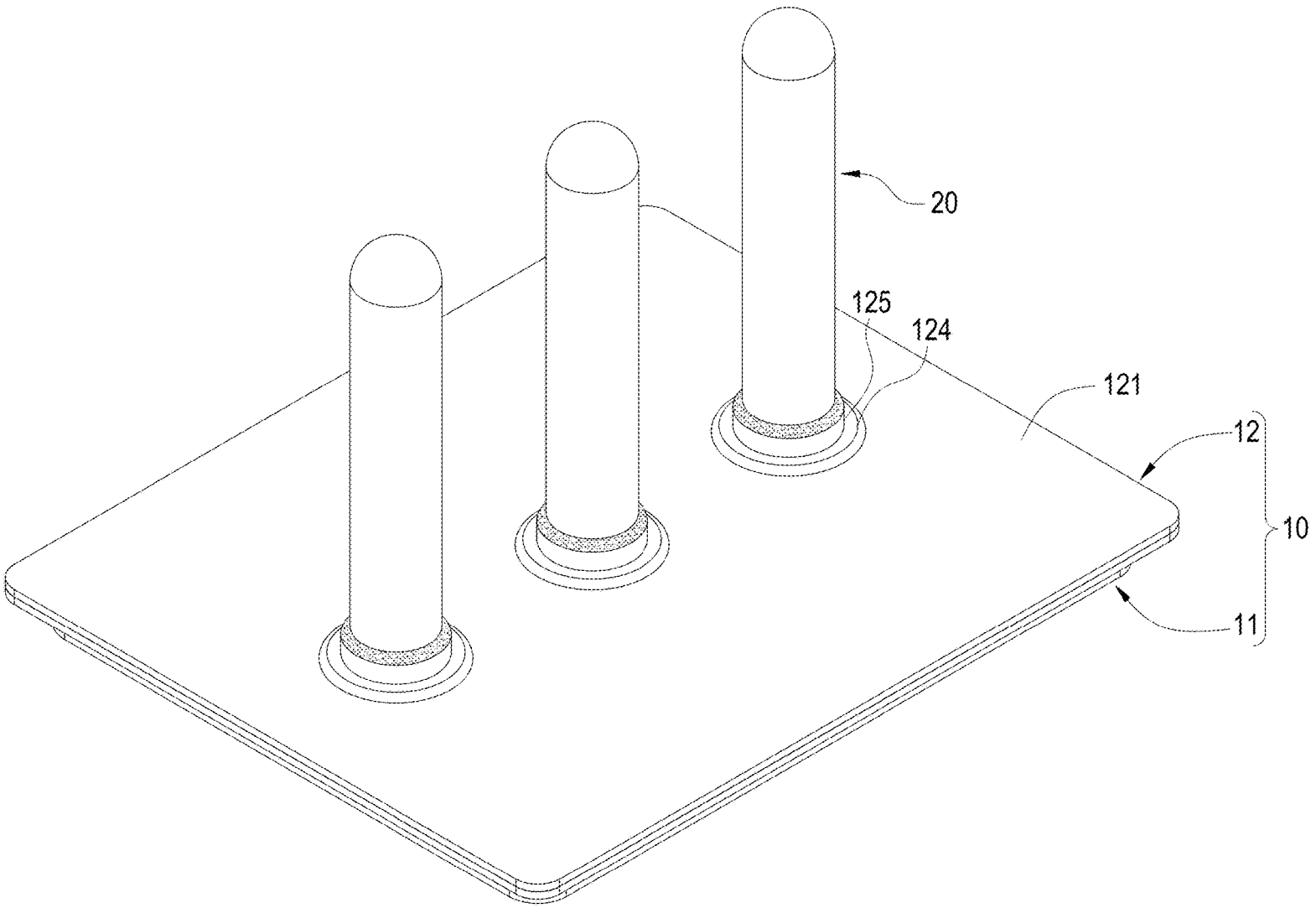
FIG. 6 is an external view of the three-dimensional vapor chamber bonding structure of the present disclosure.
Figure 7:
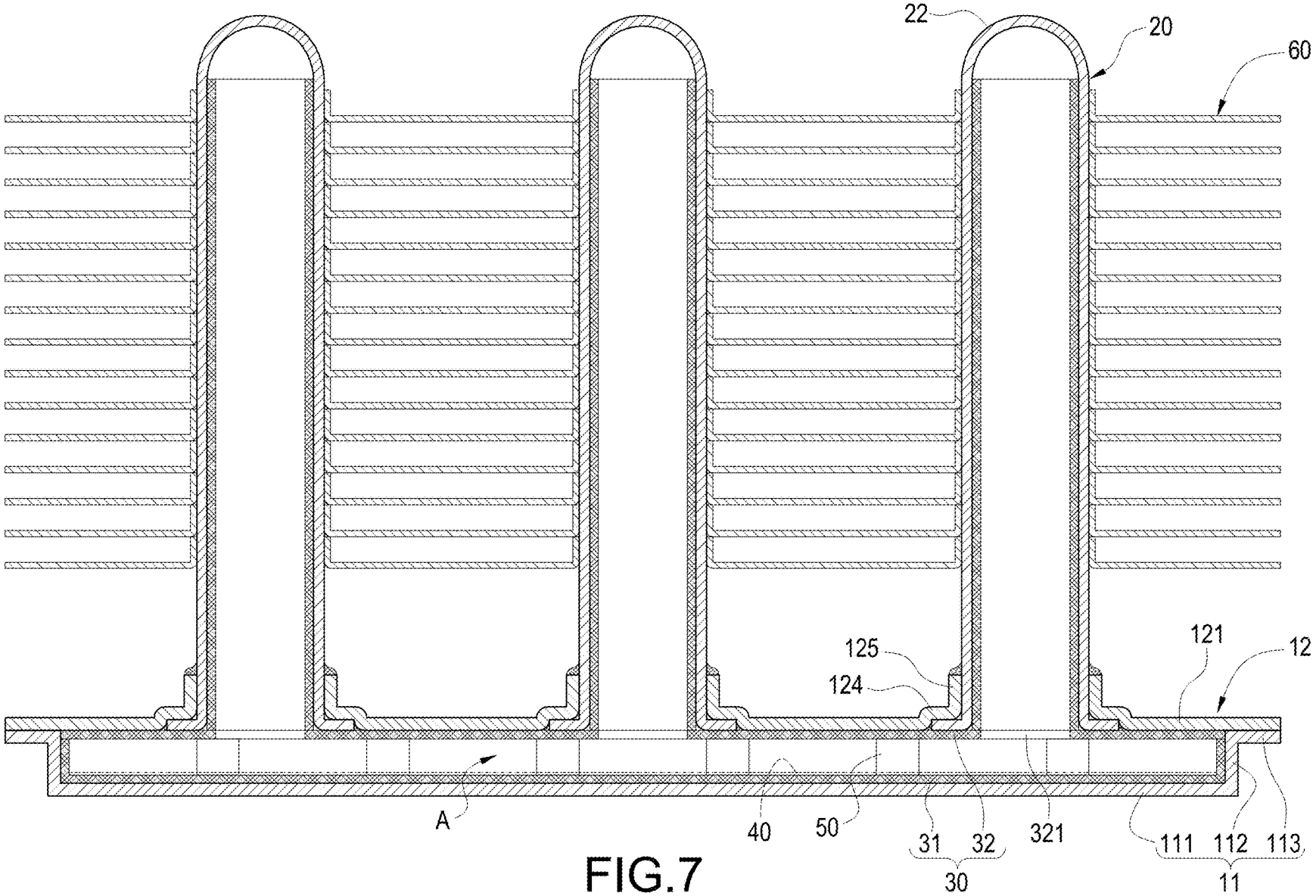
FIG. 7 is a cross-sectional view of the assembled three-dimensional vapor chamber bonding structure of the present disclosure.

Please first refer to FIGS. 5 and 7. The housing 10 mainly includes a first shell plate 11 and a second shell plate 12. The first shell plate 11 and the second shell plate 12 are made of materials with desirable thermal conductivity such as copper, aluminum, magnesium, or alloys thereof. The first shell plate 11 mainly includes a base plate 111 and a sidewall 112 that is bent upward and extends from a periphery of the base plate 111. A folded edge 113 extends outward from an end of the sidewall 112 away from the base plate 111.

The second shell plate 12 has a top plate 121. The second shell plate 12 is hermetically sealed against the folded edge 113 of the first shell plate 11 through the top plate 121 to form a cavity A between the first shell plate 11 and the second shell plate 12.

Figure 1:
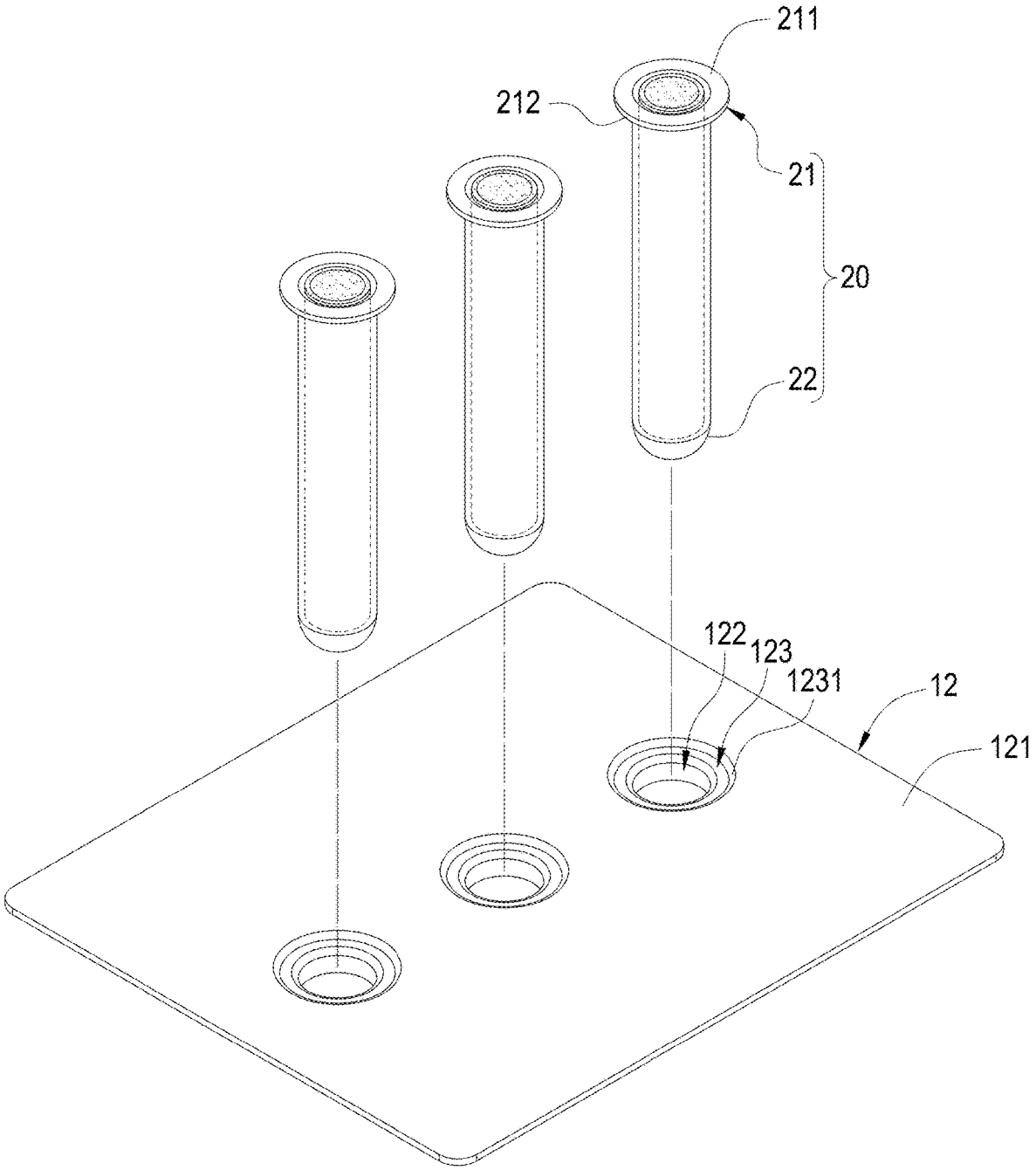
FIG. 1 is an exploded view of a second shell plate and heat pipes of the present disclosure.
Figure 2:
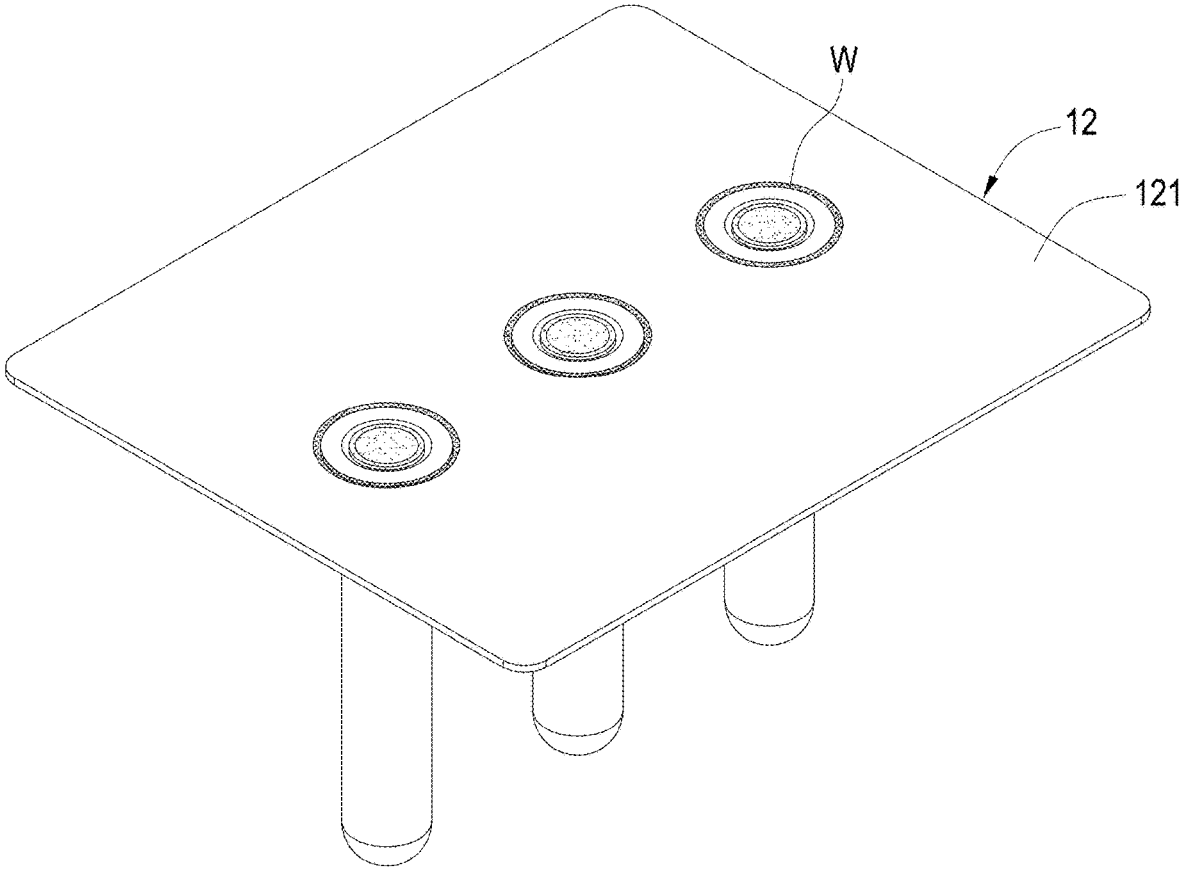
FIG. 2 is an external view of the second shell plate and the heat pipes combined in the present disclosure.
Figure 3:
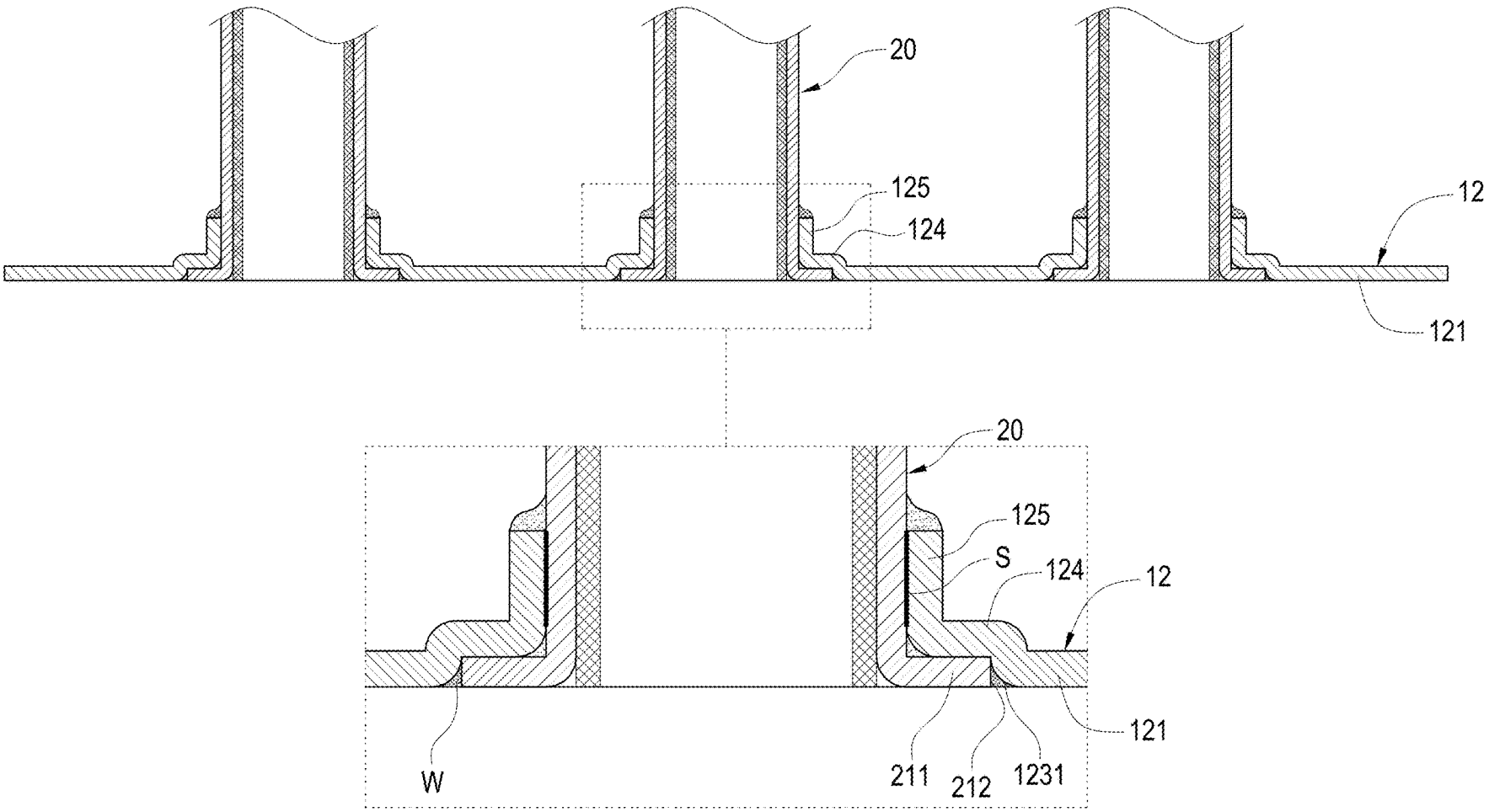
FIG. 3 is a cross-sectional view and a partial enlarged view of the second shell plate and the heat pipes combined in the present disclosure.
Figure 4:
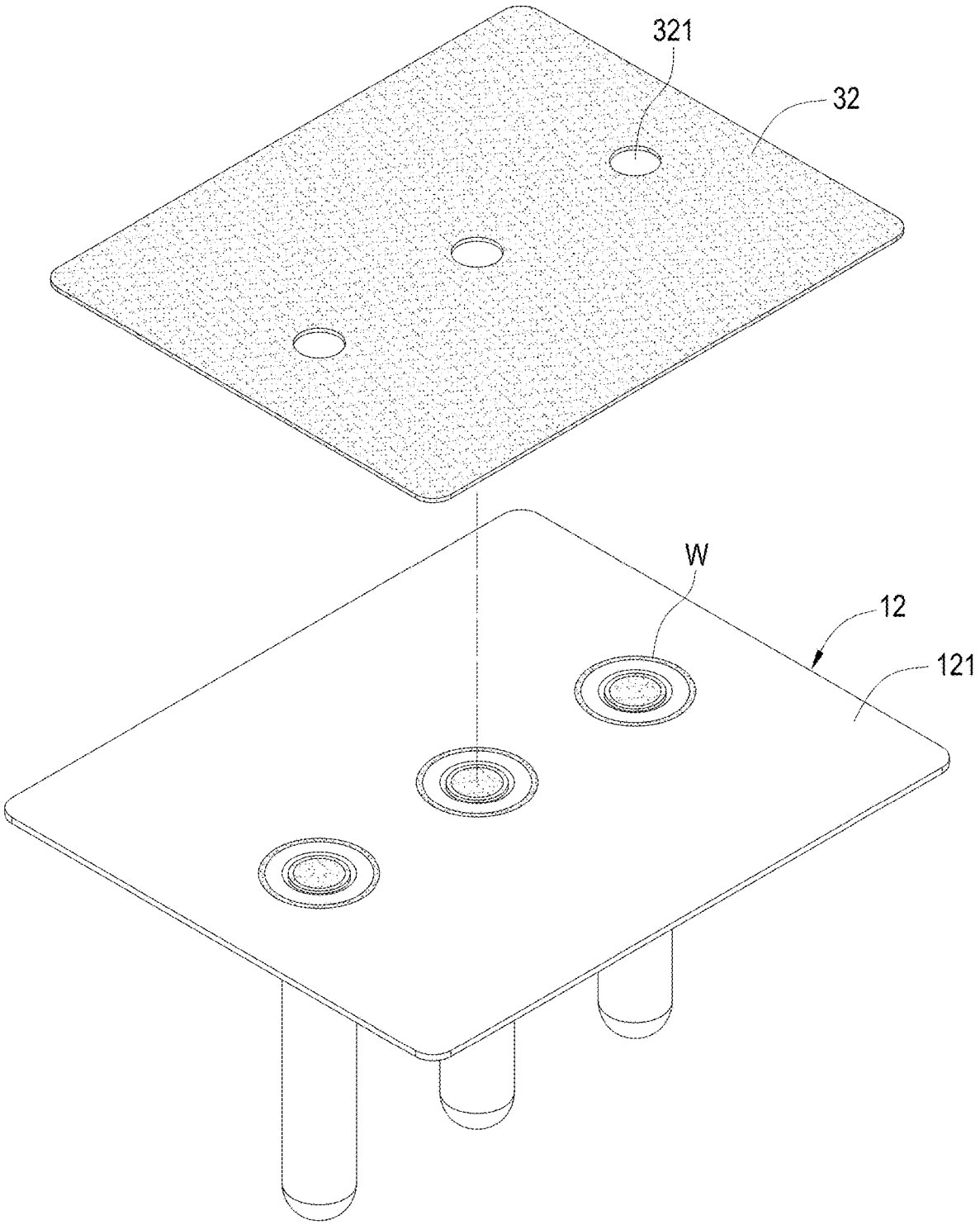
FIG. 4 is an exploded view showing the combination of the second shell plate and the heat pipes, with the capillary member separated, in the present disclosure.

Please continue to refer to FIGS. 1 to 3. A plurality of through-holes 122 are arranged at intervals on an inner side of the top plate 121 of the second shell plate 12. Each through-hole 122 is surrounded by a recessed groove 123. The recessed groove 123 includes an inner peripheral surface 1231. A protrusion 124 higher than an outer surface of the top plate 121 is formed at the position corresponding to each recessed groove 123. Additionally, a ring wall 125 extends upward from a periphery of each through-hole 122.

Each heat pipe 20 is inserted in each through-hole 122. Each heat pipe 20 includes an open end 21 and a closed end 22. A flange 211 is disposed at the open end 21. The flange 211 includes an outer peripheral surface 212. Each flange 211 is received in each recessed groove 123, and a lower surface of the flange 211 is coplanar with or lower than an inner surface of the top plate 121 of the second shell plate 12. In this embodiment, the flange 211 extends from the open end 21 of the heat pipe 20 in a radial expanding manner, and the flange 211 is positioned perpendicular to a centerline of the heat pipe 20.

During joining, the closed end 22 of the heat pipe 20 is inserted to the through-hole 122 and the ring wall 125 of the second shell plate 12, and the flange 211 is embedded in the recessed groove 123. A laser welding device (not illustrated in figures) is used to form a weldment W between the outer peripheral surface 212 of the flange 211 and the inner peripheral surface 1231 of the recessed groove 123, thereby joining each heat pipe 20 to the second shell plate 12. In this embodiment, laser brazing is used for welding, which is not only easy to use in combination with computer control, CAD/CAM, etc., but also convenient to integrate into the production line, and is also suitable for robotic welding methods. During the welding process, a high-intensity laser beam heats a linear filler metal to make it melt to be adhered between the inner peripheral surface 1231 of the recessed groove 123 and the outer peripheral surface 212 of the flange 211. After the molten filler metal is cooled and solidified, it forms the weldment W, which enables joining almost without melting the base material. This method achieves a strong, rapid bond, providing joining strength and speed that are at least twice those of conventional spot welding.

Next, solder is applied to the heat pipe 20 and the ring wall 125 by soft soldering or brazing, and the solder is filled between the heat pipe 20 and the ring wall 125 through heating, thereby forming a sealing layer S. In soft soldering, paste-like zinc, tin, and lead are used as solder; in brazing, paste-like copper, aluminum, and magnesium are used as solder.

Please continue to refer to FIGS. 4 to 7. The capillary member 30 is disposed within the aforementioned cavity A, and it can be made of materials with desirable capillary wicking capability, such as metal woven mesh, porous sintered powder, or fiber bundles. A shape of the capillary member 30 is substantially similar to the shape of the aforementioned housing 10. In this embodiment, the capillary member 30 mainly includes a lower capillary member 31 and an upper capillary structure 32. The lower capillary member 31 is adhered to the first shell plate 11 and fixed to an inner surface of the first shell plate 11 through a diffusion bonding process by heating. The upper capillary member 32 is adhered to the second shell plate 12 and fixed to an inner surface of the second shell plate 12 through a diffusion bonding process by heating. The upper capillary member 32 is further provided with a plurality of perforations 321, and the perforations 321 of the upper capillary member 32 are disposed substantially corresponding to the heat pipes 20, and the upper capillary member 32 is in contact with capillary parts of the heat pipes 20.

The working fluid 40 may be pure water, which is injected into the aforementioned cavity A, and degassing and sealing processes are performed, thereby forming the cavity A into a vacuum chamber.

In one embodiment, the three-dimensional vapor chamber bonding structure of the present disclosure further includes a plurality of support columns 50, each support column 50 is disposed at intervals within the cavity A and extends vertically between the first shell plate 11 and the second shell plate 12.

In addition, a heat sink fin assembly 60 is mounted on each heat pipe 20 during operation to enhance the heat dissipation performance of the overall structure.

The above description is only some embodiments of the present disclosure and is not intended to limit the scope of the present disclosure. Other equivalent variations that utilize the spirit of the patent of the present disclosure should all fall within the scope of the patent of the present disclosure.

What is claimed is:

1. A three-dimensional vapor chamber bonding structure, comprising:

a housing, comprising a first shell plate and a second shell plate hermetically sealed with each other, wherein a cavity is defined between the first shell plate and the second shell plate, the second shell plate comprises a plurality of through-holes, and each of the through-holes is surrounded by a recessed groove;

a plurality of heat pipes, respectively inserted in the through-holes, each of the heat pipes comprising an open end, a flange disposed on each of the open ends, the flange received in the recessed groove, wherein each of the heat pipes is joined to the second shell plate through the flange and a weldment in the recessed groove;

a capillary member, disposed in the cavity and adhered to the housing; and a working fluid, contained in the cavity;

wherein the recessed groove comprises an inner peripheral surface, the flange comprises an outer peripheral surface, and the weldment formed by laser welding is disposed between the outer peripheral surface and the inner peripheral surface;

wherein the second shell plate comprises a top plate, a protrusion is positioned higher than an outer surface of the top plate and is disposed corresponding to the recessed groove, and a ring wall extends upward from the protrusion;

wherein a lower surface of the flange is coplanar with or lower than an inner surface of the top plate of the second shell plate.

2. The three-dimensional vapor chamber bonding structure according to claim 1, wherein the flange extends from the open end of the heat pipe, and the flange is perpendicular to a centerline of the heat pipe.

3. The three-dimensional vapor chamber bonding structure according to claim 1, each of the heat pipes passes through the ring wall.

4. The three-dimensional vapor chamber bonding structure according to claim 3, further comprising a sealing layer disposed between each of the heat pipes and the ring wall.

5. The three-dimensional vapor chamber bonding structure according to claim 4, wherein the sealing layer is formed by soft soldering or brazing.

6. The three-dimensional vapor chamber bonding structure according to claim 1, further comprising a plurality of support columns, each of the support columns disposed at intervals in the cavity and extending vertically between the first shell plate and the second shell plate.

* * * * *